US007938190B2

(12) United States Patent
Talamo et al.

(10) Patent No.: US 7,938,190 B2
(45) Date of Patent: May 10, 2011

(54) ANCHORED RISERLESS MUD RETURN SYSTEMS

(75) Inventors: Emil Richard Talamo, San Antonio, TX (US); Nils Lennart Rolland, Nyborg (NO); Lyle David Finn, Sugar Land, TX (US)

(73) Assignee: AGR Subsea, Inc., Houston, TX (US)

( * ) Notice: Subject to any disclaimer, the term of this patent is extended or adjusted under 35 U.S.C. 154(b) by 605 days.

(21) Appl. No.: 11/934,410

(22) Filed: Nov. 2, 2007

(65) Prior Publication Data

US 2009/0114443 A1 May 7, 2009

(51) Int. Cl.
*E21B 29/12* (2006.01)
*E21B 15/02* (2006.01)

(52) U.S. Cl. ..... 166/358; 166/367; 175/5; 175/7; 175/38

(58) Field of Classification Search ..... 166/367, 166/364, 358; 175/5, 6, 7, 9, 370, 25, 38, 175/72

See application file for complete search history.

(56) References Cited

U.S. PATENT DOCUMENTS 3,465,817 A * 9/1969 Vincent ..... 166/355
3,815,673 A * 6/1974 Bruce et al. ..... 166/359
4,063,602 A * 12/1977 Howell et al. ..... 175/7
4,088,089 A * 5/1978 Flory ..... 114/230.14
4,091,881 A * 5/1978 Maus ..... 175/7
4,099,583 A * 7/1978 Maus ..... 175/7
4,147,221 A * 4/1979 Ilfrey et al. ..... 175/7
4,291,772 A * 9/1981 Beynet ..... 175/5
4,414,846 A * 11/1983 Dublin et al. ..... 73/152.52
4,645,467 A * 2/1987 Pollack ..... 441/4
4,653,960 A 3/1987 Chun
4,813,495 A * 3/1989 Leach ..... 175/6
5,006,845 A * 4/1991 Calcar et al. ..... 367/81
5,727,640 A * 3/1998 Gleditsch ..... 175/7
5,848,656 A * 12/1998 Møksvold ..... 175/7
6,102,673 A * 8/2000 Mott et al. ..... 417/392
6,142,236 A * 11/2000 Brammer et al. ..... 166/358
6,216,799 B1 * 4/2001 Gonzalez ..... 175/5
6,276,455 B1 8/2001 Gonzalez
6,325,159 B1 12/2001 Peterman et al.
6,328,107 B1 * 12/2001 Maus ..... 166/335
6,401,823 B1 * 6/2002 Gonzalez et al. ..... 166/319
(Continued)

OTHER PUBLICATIONS

PCT/US2008/081262 International Search Report and Written Opinion, Apr. 24, 2009.

*Primary Examiner* — Thomas A Beach
(74) *Attorney, Agent, or Firm* — Conley Rose, PC; Richard A. Fagin

(57) ABSTRACT

A riserless mud recovery system including a mud return line secured by an anchor is disclosed. Some system embodiments for drilling a well bore in an offshore location having a water surface and a subsea formation include an offshore structure positioned on a platform at a water surface, a drill string for forming the well bore suspended from the offshore structure, a drilling fluid source on the platform for supplying drilling fluid through the drill string, a suction module for collecting the drilling fluid emerging from the well bore, a return pipe coupled to the suction module, a pump for receiving the drilling fluid from the suction module and pumping the drilling fluid through the return pipe to a location at the water surface, and an anchor for securing the return pipe, where the anchor is coupled to the return pipe and the subsea formation.

13 Claims, 6 Drawing Sheets

U.S. PATENT DOCUMENTS 6,415,877 B1 * 7/2002 Fincher et al. ..... 175/5
6,454,022 B1 * 9/2002 Sangesland et al. ..... 175/7
6,457,529 B2 * 10/2002 Calder et al. ..... 166/368
6,474,422 B2 * 11/2002 Schubert et al. ..... 175/69
6,527,054 B1 * 3/2003 Fincher et al. ..... 166/357
6,648,081 B2 * 11/2003 Fincher et al. ..... 175/25
6,668,943 B1 * 12/2003 Maus et al. ..... 175/5
6,745,851 B1 6/2004 Edvardsen
6,745,857 B2 * 6/2004 Gjedebo ..... 175/69
6,823,950 B2 * 11/2004 von Eberstein et al. ..... 175/5
6,854,532 B2 2/2005 Fincher et al.
6,966,367 B2 * 11/2005 Butler et al. ..... 166/105
7,063,158 B2 * 6/2006 Horton, III ..... 166/355
7,264,058 B2 9/2007 Fossli

* cited by examiner

ANCHORED RISERLESS MUD RETURN SYSTEMS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Embodiments of the invention relate to riserless mud return systems used in drilling subsea wells for the production of oil and gas. More particularly, embodiments of the invention relate to a systems and methods for riserless mud return using a mud return line secured to the sea floor by an anchor.

Top hole drilling is generally the initial phase of the construction of a subsea well and involves drilling in shallow formations prior to the installation of a subsea blowout preventer. During conventional top hole drilling, a drilling fluid, such as drilling mud or seawater, is pumped from a drilling rig down the borehole to lubricate and cool the drill bit as well as to provide a vehicle for removal of drill cuttings from the borehole. After emerging from the drill bit, the drilling fluid flows up the borehole through the annulus formed by the drill string and the borehole. Because conventional top hole drilling is normally performed without a subsea riser, the drilling fluid is ejected from the borehole onto the sea floor.

When drilling mud, or some other commercial fluid, is used for top hole drilling, the release of drilling mud in this manner is undesirable for a number of reasons, namely cost and environmental impact. Depending on the size of the project and the depth of the top hole, drilling mud losses during the top hole phase of drilling can be significant. In many regions of the world, there are strict rules governing, even prohibiting, discharges of certain types of drilling mud. Moreover, even where permitted, such discharges can be harmful to the maritime environment and create considerable visibility problems for remote operated vehicles (ROVs) used to monitor and perform various underwater operations at the well sites.

For these reasons, systems for recycling drilling mud have been developed. Typical examples of these systems are found in U.S. Pat. No. 6,745,851 and W.O. Patent Application No. 2005/049958, both of which are incorporated herein by reference in their entireties for all purposes. Both disclose systems for recycling drilling fluid, wherein a suction module, or equivalent device, is positioned above the wellhead to convey drilling mud from the borehole through a pipeline to a pump positioned on the sea floor. The pump, in turn, conveys the drilling mud through a flexible return line to the drilling rig above for recycling and reuse. The return line is anchored at one end by the pump, while the other end of the return line is connected to equipment located on the drilling rig. In certain applications, such as in deep water and strong currents, the use of a flexible return line may not be desirable.

Thus, the embodiments of the invention are directed to riserless mud return systems that seek to overcome these and other limitations of the prior art.

SUMMARY OF THE PREFERRED EMBODIMENTS

Systems and methods for riserless mud return systems including a mud return line secured by an anchor, which is not a subsea pump or other mechanism that moves the fluid to the surface, are disclosed. Some system embodiments include an offshore structure positioned on a platform at a water surface, a drill string with a bottom hole assembly adapted to form the well bore and suspended from the offshore structure, and a drilling fluid source for supplying drilling fluid through the drill string to the bottom hole assembly. The drilling fluid exits from the bottom hole assembly during drilling and returns up the well bore. These system embodiments further include a suction module for collecting the drilling fluid emerging from the well bore, a return conduit coupled to the suction module, a pump for receiving the drilling fluid from the suction module and pumping the drilling fluid through the return conduit to a location at the water surface, and an anchor for securing the return conduit. The anchor is coupled to the return conduit and the sea floor.

Some embodiments include driving a bit mounted at an end of a drill string to form a well bore in a subsea formation, injecting a drilling fluid into the drill string, collecting the drilling fluid after the drilling fluid passes through the drill string, returning the drilling fluid to a location at the water surface through a pipe using a subsea pump, and anchoring the pipe to the subsea formation.

Some embodiments include a suction module for mounting over a well bore in sealed relation to the surrounding seawater to prevent leakage of drilling fluid from the well bore, a floating drilling vessel operable to supply a drilling fluid to a drill string disposed in the well bore, at least one pump module spaced from and connected to said suction module to effect a differential pressure therein for pumping drilling fluid from said sealing device upwardly to said floating drilling vessel, a return line providing fluid communication between said suction module and said floating drilling vessel, wherein said return line is in fluid communication with said pump module, and an anchor that couples said return line to the sea floor.

Thus, embodiments of the invention comprise a combination of features and advantages that enable substantial enhancement of riserless mud return systems. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
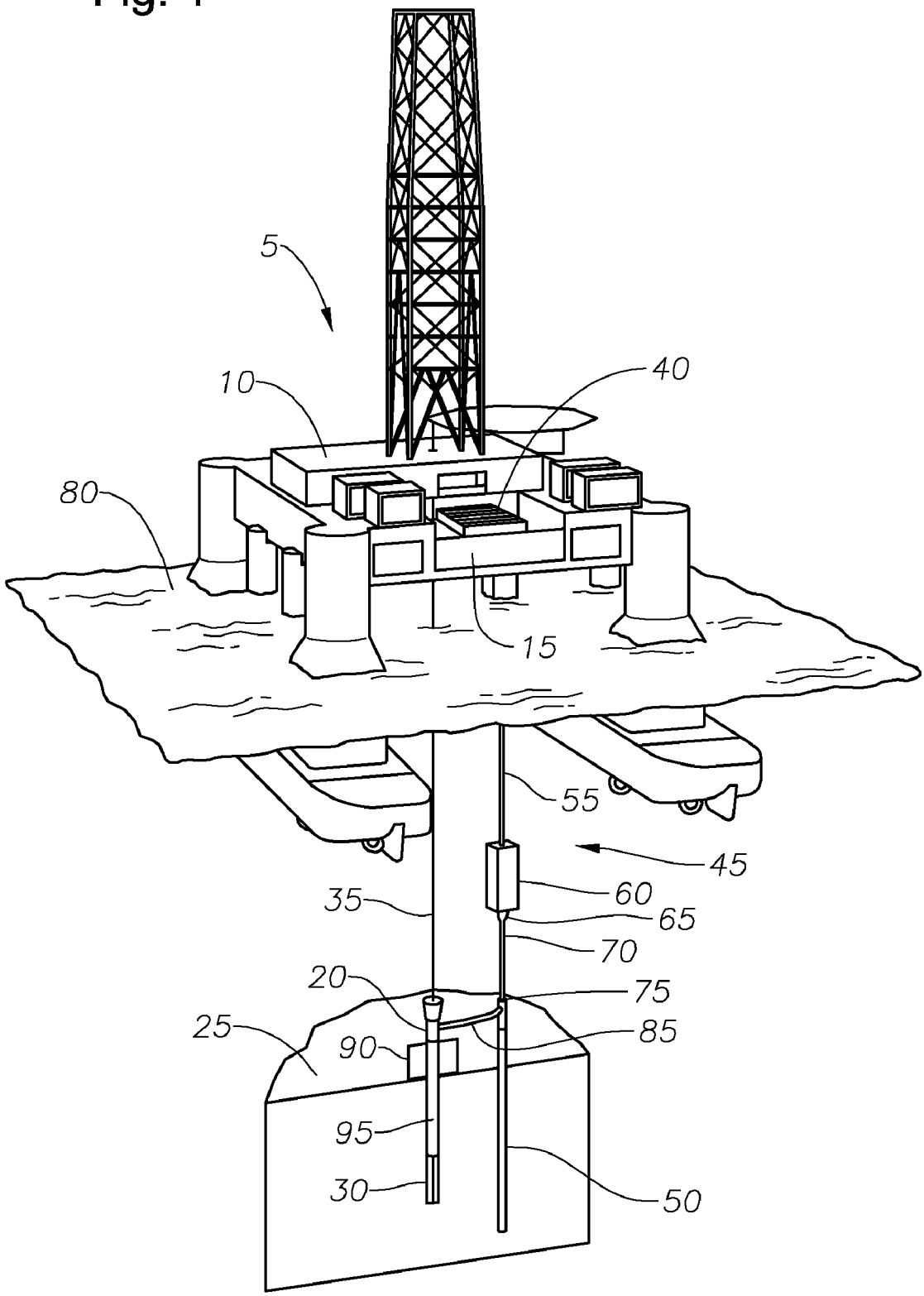
FIG. 1 is a representation of a drilling rig with a riserless mud return system comprising a mud return line secured by an anchor in accordance with embodiments of the invention.

Various embodiments of the invention will now be described with reference to the accompanying drawings, wherein like reference numerals are used for like parts throughout the several views. The figures are not necessarily to scale. Certain features of the invention may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . ". Also, the terms "couple," "couples", and "coupled" used to describe any connections are each intended to mean and refer to either an indirect or a direct connection.

The preferred embodiments of the invention relate to riserless mud return systems used in the recycling of drilling mud during top hole drilling. The invention is susceptible to embodiments of different forms. There are shown in the drawings, and herein will be described in detail, specific embodiments of the invention with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

Referring now to FIG. 1, drilling rig 5 comprises drill floor 10 and moonpool 15. An example of an offshore structure, drilling rig 5 is illustrated as a semi-submersible floating platform, but it is understood that other platforms or structures may also be used. For example, offshore structures include, but are not limited to, all types of rigs, barges, ships, spars, semi-submersibles, towers, and/or any fixed or floating platforms, structures, vessels, or the like.

Suction module 20 is coupled to jet casing wellhead 90, which is positioned on the sea floor 25 above borehole 30. Drill string 35, including bottom hole assembly 95, is suspended from drill floor 10 through suction module 20 and jet casing wellhead 90 into borehole 30. Deployment and hang-off system 40 is positioned adjacent to moonpool 15 and supports return string 45, which is secured to the sea floor 25 by anchor 50. Return string 45 further comprises upper mud return line 55, pump module 60, docking joint 65, lower mud return line 70, and emergency disconnect 75. Although this exemplary embodiment depicts return string 45 coupled to drilling rig 5, it is understood that, in other embodiments, return string 45 may be coupled to and supported by the same or another offshore structure and can return fluid to the same offshore structure as coupled to the drill string 35 or to a second offshore structure.

Upper and lower mud return lines 55, 70 are both preferably formed from drill pipe, but may be formed from other suitable material known in the industry, such as coiled or flexible tubing. Accordingly, reference herein will be made to drill pipe, but it should be understood that the invention is not so limited. Thus, mud return lines 55, 70 are formed from a series of individual lengths of drill pipe connected in series to form the continuous conduit. Upper mud return line 55 is connected at its upper end to deployment and hang-off system 40 and at its lower end to docking joint 65, which is located below sea level 80. Pump module 60 is releasably connected to docking joint 65. Preferably, pump module 60 is coupled to return string 45 below sea level 80 and above sea floor 25. See U.S. patent application Ser. No. 11/833,010, entitled Return Line Mounted Pump for Riserless Mud Return System, which is hereby incorporated herein by reference in its entirety for all purposes.

Lower mud return line 70 runs from docking joint 65 and is secured to the sea floor by anchor 50. In certain embodiments, emergency disconnect 75 may releasably couple lower mud return line 70 to anchor 50. Suction hose assembly 85 extends from suction module 20 to lower mud return line 70 so as to provide fluid communication from the suction module to lower mud return line 70.

Prior to initiating drilling operations, return string 45 is installed through moonpool 15. Installation of return string 45 includes coupling anchor 50 and emergency disconnect 75 (if desired) to lower mud return line 70. Anchor 50 is preferably lowered to sea floor 25 by adding individual joints of pipe that extend the length of lower mud return line 70. As return string 45 is installed, docking joint 65 and upper mud return line 55 are added. Pump module 60 may be run with return string 45 or after the string has been completely installed. Upon reaching the sea floor 25, anchor 50 is installed to secure return string 45 to the sea floor 25. Return string 45 is then suspended from deployment and hang-off system 40 and drilling operations may commence.

During drilling operations, drilling mud is delivered down drill string 35 to a drill bit positioned at the end of drill string 35. After emerging from the drill bit, the drilling mud flows up borehole 30 through the annulus formed by drill string 35 and borehole 30. At the top of borehole 30, suction module 20 collects the drilling mud. Pump module 60 draws the mud through suction hose assembly 85, lower mud return line 70, and docking joint 65 and then moves the mud upward through upper mud return line 55 to drilling rig 5 for recycling and reuse. During operation, anchor 50 limits movement of return string 45 in order to prevent the return string from impacting other submerged equipment.

Figure 2:
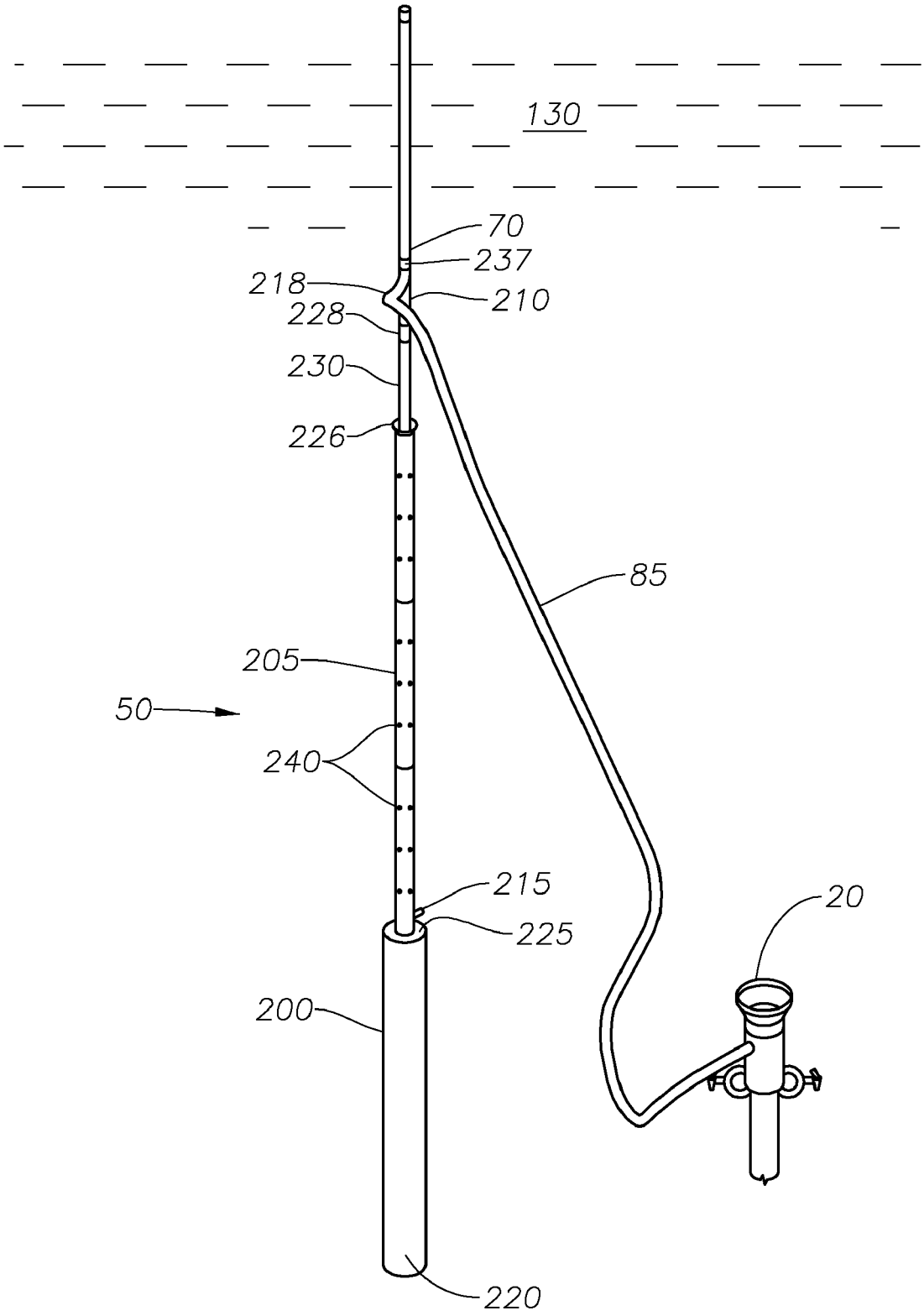
FIG. 2 is schematic representation of the anchor depicted in FIG. 1.

FIG. 2 is a schematic representation of a preferred embodiment of anchor 50. Anchor 50 comprises suction anchor 200, perforated guide tube for sliding mass 205, sliding mass 230, foundation plate 225, drill collar to mass adaptor 228, shackles 210, return line elbow with hang-off pad 237 and hose swivel 218. Suction anchor 200 is a hollow member further comprising open lower end. Guide tube 205 is coupled to suction anchor 200 by foundation plate 225 and further comprises open upper end 226, a plurality of perforations 240 through the wall of guide tube 205, and suction port with remotely operated vehicle (ROV) docking joint 215. Sliding mass 230 is inserted into open upper end 226 of guide tube 205 and configured to slide upward and downward within guide tube 205. Perforations 240 in guide tube 205 allow seawater to flow therethrough, thereby reducing resistance encountered by sliding mass 230 as sliding mass 230 translates within guide tube 205.

Sliding mass 230 is coupled via drill collar to mass adaptor 228 and shackles 210 to mud return line elbow hang-off pad 237 or an emergency disconnect 75 (shown in FIG. 1). Preferably, hose swivel 218 couples suction hose assembly 85, extending from suction module 20, to lower mud return line 70 so as to provide fluid communication from the suction module to the mud return line. Moreover, hose swivel 218 is configured to allow rotation of suction hose assembly 85 about the coupling of mud return line 70 and sliding mass tube 205.

Prior to installation, anchor 50 is assembled on drilling rig 5 and coupled to return mud line 70, or emergency disconnect 75. During installation, anchor 50 is lowered via mud return line 70 to the sea floor 25. Due to its mass and open end 220, suction anchor 200 imbeds into the soil upon landing on the sea floor 25. An ROV docks to the suction anchor 200 at suction port 215 and pumps seawater from suction anchor 200 to achieve final penetration into the sea floor 25. Suction hose assembly 85 may then be coupled to suction module 20 and to hose swivel 218 of anchor 50. Once coupled to suction hose assembly 85, hose swivel 218 makes manipulating suction hose assembly 85 easier.

Once installed, anchor 50 limits displacement of the lower end of return string 45 relative to drill string 35 caused by surrounding water currents 130 and weather and sea state induced motions on drilling rig 5. Anchor 50 substantially prevents lateral movement of return string 45, thereby preventing return string 45 from displacing and contacting other submerged equipment and drilling rig 5. At the same time, anchor 50 permits some vertical movement of return string 45 as sliding mass 230 translates within guide tube 205. Additionally, perforations 240 in tube 205 further enable such vertical movement by allowing water, which may be contained in perforated guide tube 205, to be forced out through perforations 240 as sliding mass 230 translates downward inside guide tube 205. Thus, anchor 50 provides a flexible connection between return string 45 and the sea floor 25, which alleviates wear to the other components of return string 45 caused by forces from changing water currents 130 and some drill rig 5 movements caused by sea state and weather, thereby increasing their service life.

Moreover, hose swivel 218 enables lower stresses on the coupling of suction hose assembly 85 to mud return line 70, or emergency disconnect 75. As the mud return line 70 and suction hose assembly 85 move in response to surrounding currents 130 and some drill rig 5 movements caused by sea state and weather, hose swivel 218 allows rotation of suction hose assembly relative to mud return line 70 and sliding mass tube 205, thereby reducing the stresses at this connection. This too permits increased service lives for the affected components.

Figure 3:
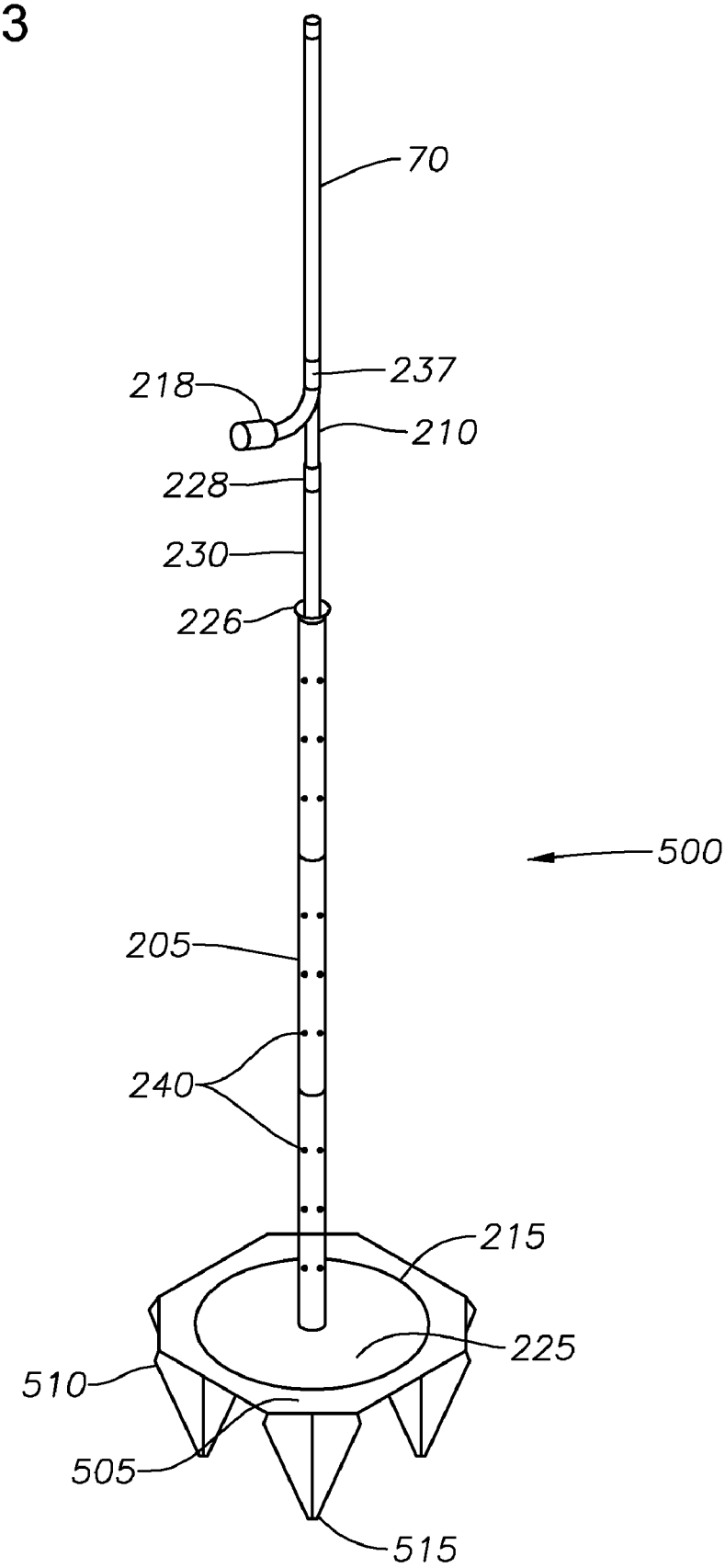
FIG. 3 is a schematic representation of an embodiment of the anchor depicted in FIG. 2 but adapted for use in a firm seabed solid.

FIG. 3 is a schematic representation of an embodiment of anchor 50 depicted in FIGS. 1 and 2, but adapted for use in a firm seabed. In this exemplary embodiment, anchor 500 does not comprise suction anchor 200 (FIG. 2). Instead, guide tube 205 is coupled to wedge anchor jet in manifold 505 by foundation plate 225. Wedge anchor 505 further comprises suction port with ROV docking joint 215 and wedge anchor blades 510 preferably shaped to limit lateral movement of the return string 45 once the blades 510 are embedded in the sea floor 25. Each blade 510 further comprises a nozzle 515 at its tip to enable embedding of blades 510 in the sea floor 25.

Assembly, installation and operation of anchor 500 are in most ways similar to that described above in reference to FIG. 2 for anchor 50. Anchor 500 can be assembled on drilling rig 5 and coupled to return mud line 70, or emergency disconnect 75. During installation, anchor 500 can be lowered via mud return line 70 to the sea floor 25. Due to its mass and the shape of blades 510, anchor 500, or more specifically, blades 510 of manifold 510, imbeds into the soil upon landing on the sea floor 25. An ROV docks to the manifold 510 at suction port 215 and pumps seawater into manifold 510. The injected seawater then flows through the manifold 510, out of the nozzles 515 and into the seabed to liquefy the seabed. Softening of the seabed in this manner allows anchor 500 to achieve final penetration into the sea floor 25. Once installed, anchor 500 limits displacement of the lower end of return string 45 relative to drill string 35 caused by surrounding water currents 130 and weather and sea state induced motions on drilling rig 5.

Figure 4:
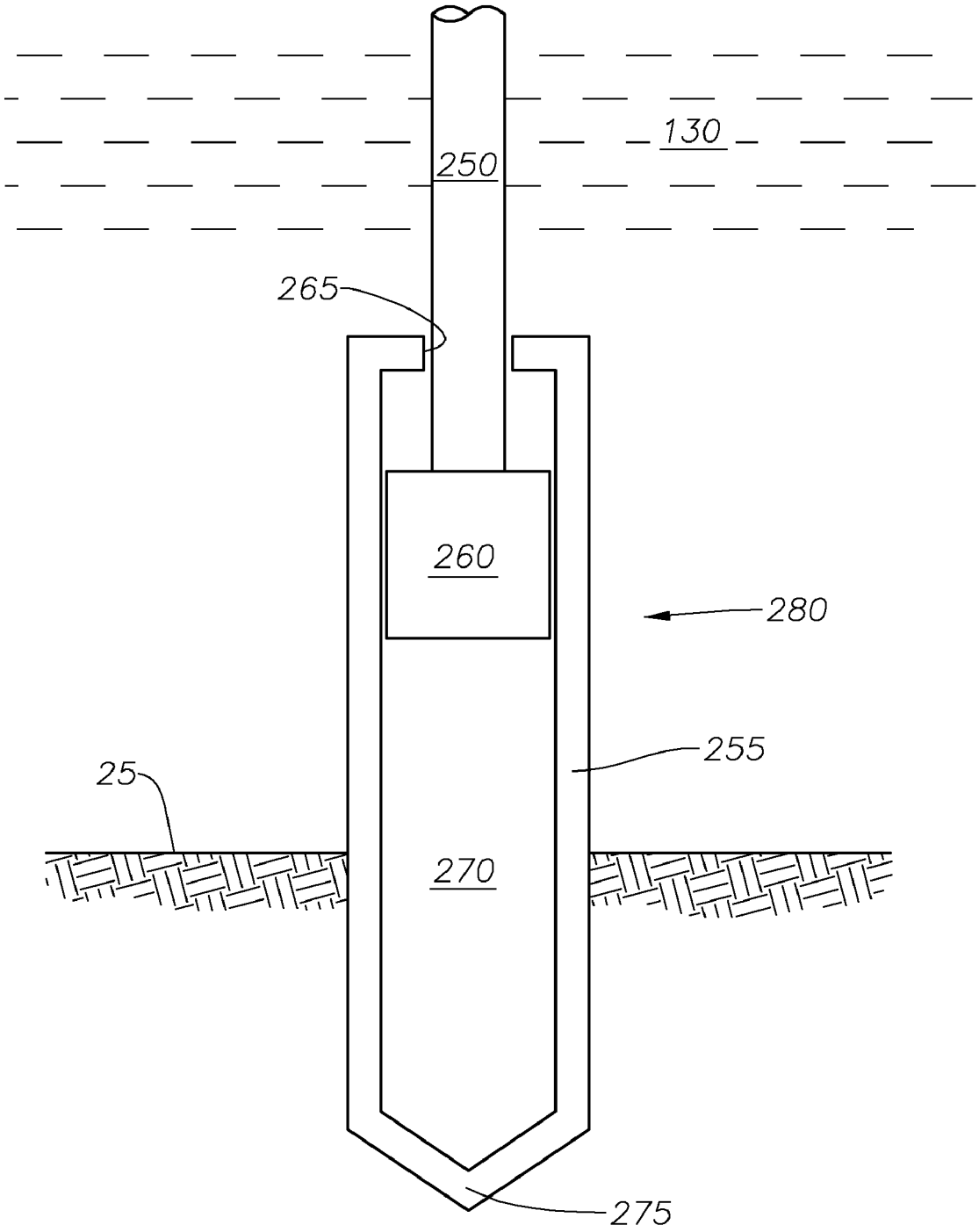
FIG. 4 is a cross-sectional view of another anchor in accordance with embodiments of the invention.

FIG. 4 is an enlarged cross-sectional view of another anchor in accordance with embodiments of the invention. Anchor 280 comprises pipe conduit 250, housing 255, and retainer 260. Housing 255 further comprises opening 265, cavity 270, and tip 275 at its lower end. Retainer 260 is disposed within housing 255 and has an outer diameter that is larger than opening 265 in housing 255. Conduit 250 is coupled to retainer 260 within cavity 270 and extends through opening 265 of housing 255. The upper end of conduit 250 is connected to the lower mud return line 70 or an emergency disconnect 75 (shown in FIG. 1). Retainer 260, with attached conduit 250, is free to translate along cavity 270 within housing 255.

Tip 275 of anchor 280 is preferably shaped so as to penetrate sea floor 25 as anchor 280 is lowered via return string 45 (shown in FIG. 1). Upon reaching the sea floor 25, anchor 280 is installed to secure return string 45 to the sea floor 25. Anchor 280 will initially imbed itself in sea floor 25 due to its own weight. Anchor 280 can then be further set into sea floor 25 by repeatedly lifting and dropping return string 45, causing retainer 260 to translate upward in cavity 270 and then downward to impact tip 275 within housing 255. The impact of tip 275 by retainer 260 will drive tip 275 into the sea floor 25. The lifting and dropping process is repeated until anchor 280 is driven to a desired depth in the sea floor 25.

Once installed, anchor 280 limits displacement of return string 45 caused by surrounding water currents 130. Anchor 280 substantially prevents lateral movement of return string 45, thereby preventing return string 45 from displacing and contacting other submerged equipment and drilling rig 5. At the same time, anchor 280 permits some vertical movement of return string 45 as retainer 260, with attached pipe 250, translates within cavity 270 of housing 255. Thus, anchor 280 provides a flexible connection between return string 45 and the sea floor 25, which alleviates wear to the other components of return string 45 caused by forces from changing water currents 130, thereby increasing their service life.

Figure 5:
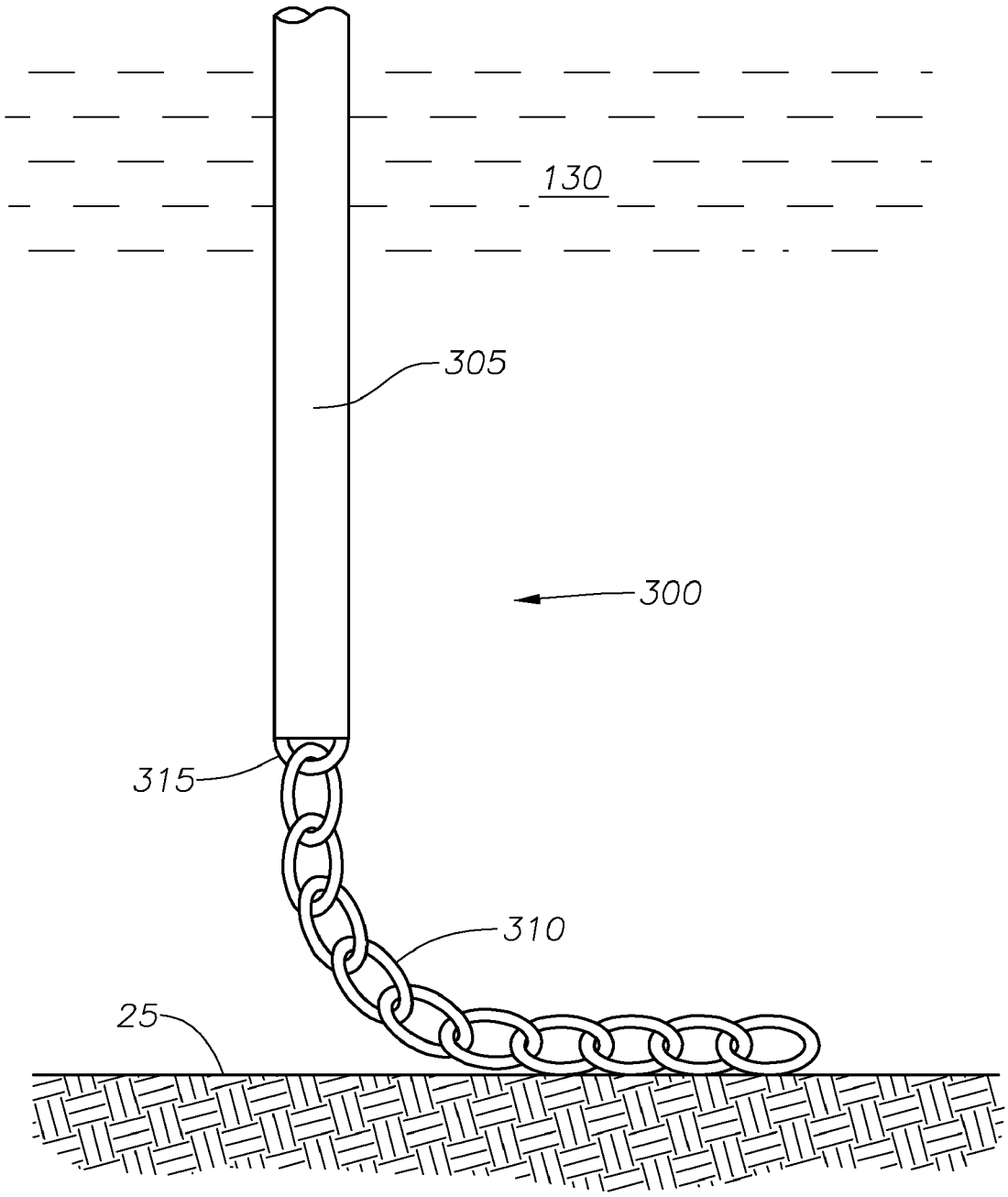
FIG. 5 is a cross-sectional view of yet another anchor in accordance with embodiments of the invention.

FIG. 5 is a cross-sectional view of another anchor in accordance with embodiments of the invention. Anchor 300 comprises conduit 305 connected at its lower end to chain 310 by connector 315. The upper end of conduit 305 is connected to lower mud return line 70 or emergency disconnect 75 (shown in FIG. 1). Chain 310 is of sufficient weight to anchor return string 45 (shown in FIG. 1) to the sea floor 25. To achieve the necessary weight, chain 310 may comprise dense materials and/or have extensive length. Chain 310 is also flexible to permit limited displacement of conduit 305. Moreover, chain 310 and connector 315 are capable of withstanding tension loads imparted to these components by movement of conduit 305 in response to surrounding water currents 130. In some embodiments, chain 310 is a metal link chain, but may be made of any suitable material.

Figure 6:
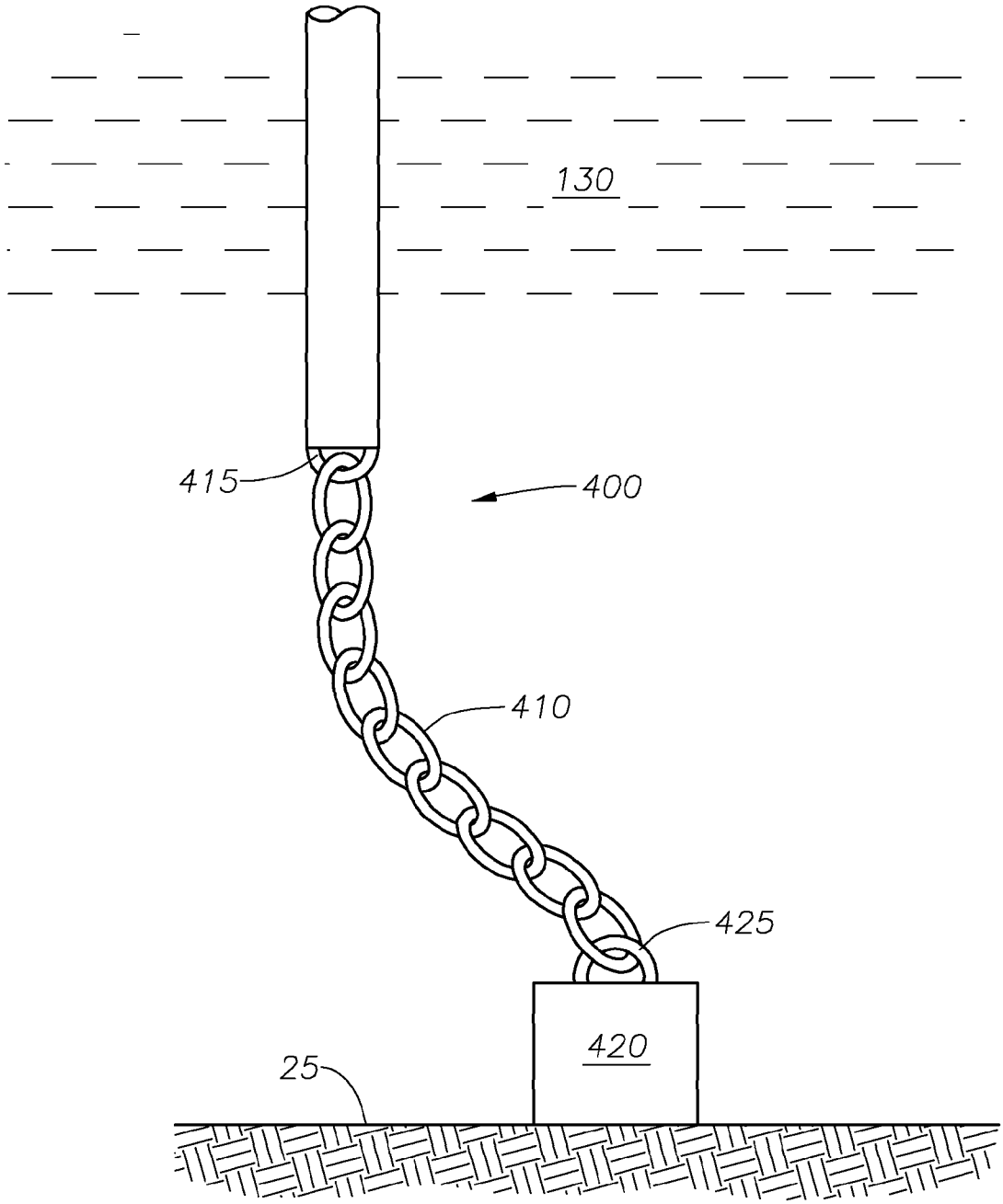
FIG. 6 is a cross-sectional view of still another anchor in accordance with embodiments of the invention.

FIG. 6 is a cross-sectional view of another anchor in accordance with embodiments of the invention. Embodiments of the anchor exemplified by FIG. 6 are similar to those illustrated by FIG. 5 with one primary difference. In embodiments exemplified by FIG. 6, a weight is used to anchor return string 45 to the sea floor 25, rather than additional chain length. It should be appreciated that a portion of the chain 410 may also rest on the sea floor 25.

As shown in FIG. 6, anchor 400 comprises conduit 405 connected at its lower end to the upper end of chain 410 by connector 415. The upper end of conduit 405 is connected to lower mud return line 70 or emergency disconnect 75 (shown in FIG. 1). The lower end of chain 410 is connected to weight 420 by connector 425. Weight 420 is of sufficient weight to anchor return string 45 (shown in FIG. 1) to the sea floor 25. Chain 410 is flexible to permit limited displacement of conduit 405. Moreover, chain 410, connector 415, and connector 425 are capable of withstanding tension loads imparted to these components by movement of conduit 405 in response to surrounding water currents 130. In some embodiments, chain 410 is a metal link chain, but can be made from any suitable material.

Once installed, anchor 400 limits displacement of return string 45 caused by surrounding water currents 130. Due to the weight of weight 420, anchor 400 limits movement of return string 45, thereby preventing return string 45 from displacing and contacting other submerged equipment and drilling rig 5. At the same time, the flexible nature of chain 410 enables anchor 400 to provide a flexible connection between return string 45 and the sea floor 25. The flexibility of anchor 400 alleviates wear to the other components of return string 45 caused by forces from changing water currents 130 and thus increases their service life.

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. In particular, the sliding mass tube and suction anchor in FIG. 1 are not limited to the circular shapes shown, but may assume other physical forms. Similarly, the retainer and weight depicted in FIG. 6 are also not limited to the shapes shown, but may assume other physical forms. Lastly, the chains depicted in FIGS. 5 and 6 are not limited to the design configuration shown, but may assume other physical forms that are flexible and have sufficient strength and weight, and the housing, conduit, and tip of the anchor of FIG. 4 may take any physical form. Accordingly, the scope of protection is not limited to the embodiments described herein, but is only limited by the claims that follow, the scope of which shall include all equivalents of the subject matter of the claims.

What is claimed is:

1. A fluid return system for use in an offshore location having a water surface and a sea floor, comprising:

a drill string having a distal end and being suspended from above the water surface and into a well bore;

a drilling fluid source for supplying drilling fluid through said distal end of said drill string, said drilling fluid returning up the well bore;

a suction module for collecting said drilling fluid emerging from the well bore;

a return conduit fluidly coupled to said suction module;

a pump disposed on said return conduit below the water surface and above the sea floor and operable to pump the drilling fluid through said return conduit to a location at the water surface;

an anchor coupled to said return conduit for securing said return conduit to the sea floor, wherein said anchor comprises a first elongated member and a second elongated member coupled to said return conduit and translatable within the first elongated member, a housing having a cavity therein, a first end, and a second end, and wherein the first elongated member has a cavity therein and a first end coupled to the second end of the housing, and a first opening at a second end, wherein the second elongated member has a first end inserted through the first opening into the cavity of the first elongated member and a second end coupled to the return conduit; and wherein the second elongated member is free to translate within the cavity of the first elongated member, wherein the first elongated member further comprises a plurality of perforations.

2. The system of claim 1, wherein the first elongated member further comprises a suction port configured to permit removal of water contained within the cavity of the housing.

3. The system of claim 1, wherein the anchor further comprises:

a manifold having a suction port, one or more blades, wherein each blade comprises a nozzle, and a flowpath between the suction port and each nozzle; and wherein the first elongated member has a cavity therein, a first end coupled to the manifold, and a first opening at a second end; and the second elongated member has a first end inserted through the first opening into the cavity of the first elongated member and a second end coupled to the return conduit;

wherein the second elongated member is free to translate within the cavity of the first elongated member.

4. The system of claim 3, wherein the first elongated member further comprises a plurality of perforations.

5. The system of claim 1, wherein the anchor further comprises: a cavity and an opening to the cavity;

a retainer disposed within the cavity and coupled to the second elongated member, wherein a cross-section of the retainer is larger than the opening to the cavity; and wherein the retainer is free to translate within the cavity of the first elongated member.

6. A method for returning a fluid from the sea floor to the surface during offshore drilling, comprising:

creating a well bore in the sea floor;

injecting a drilling fluid into the well bore;

removing the fluid from the well bore through a return conduit using a subsea pump;

coupling the return conduit to the sea floor using an anchor, wherein the anchor comprises a first elongated member and a second elongated member coupled to the return conduit and translatable within the first elongated member, wherein said anchor further comprises a manifold having a suction port, one or more blades, wherein each blade comprises a nozzle, and a flowpath between the suction port and each nozzle, and wherein the first elongated member has a cavity therein, a first end coupled to the manifold, and a first opening at a second end, and the second elongated member has a first end inserted through the first opening into the cavity of the first elongated member and a second end coupled to the return conduit, wherein the second elongated member is free to translate within the cavity of the first elongated tube, and wherein said coupling step further comprises lowering the return conduit to position the anchor in close proximity to the sea floor, and dropping the return conduit, wherein said dropping embeds the one or more blades into the sea floor; and substantially preventing lateral movement of the return conduit and permitting vertical movement of the return conduit.

7. The method of claim 6, wherein the first elongated member has a tip, a cavity, and an opening to the cavity: wherein the anchor further comprises a retainer coupled to the second elongated member, the retainer disposed within the cavity and free to translate within the cavity and wherein said coupling further comprises:

lifting the return conduit, said return conduit coupled to the anchor; and dropping the return conduit;

whereby the tip of the anchor is driven into the sea floor.

8. The method of claim 6, further comprising:

coupling a device to a suction port coupled to the first elongated member; and removing water contained within the cavity of the housing through the suction port using the device.

9. A system for processing drilling fluid from an offshore location having a surface and a sea floor, the system comprising:

a suction module for mounting over a well bore in sealed relation to the surrounding seawater to prevent leakage of drilling fluid from the well bore;

an offshore structure operable to supply a drilling fluid to a drill string disposed in the well bore;

at least one pump module spaced from and connected to said suction module to effect a differential pressure therein for pumping drilling fluid from said sealing device upwardly to the surface;

a return conduit providing fluid communication between said suction module and said offshore structure, wherein said return conduit is in fluid communication with said pump module; and an anchor that couples said return line to the sea floor, wherein said anchor comprises a first portion an a second portion coupled to said return conduit and translatable within the first portion, wherein the first portion is a first elongated member and wherein the second portion is a second elongated member, the second elongated member translatable within the first elongated member;

wherein the anchor further comprises a housing having a cavity therein, a first end, and a second end and wherein the first elongated member has a cavity therein, a first end of the first elongated member coupled to the second end of the housing, and a first opening at a second end of the first elongated member and the second elongated member has a first end inserted through the first opening of the first elongated member into the cavity of the first elongated tube and a second end coupled to the return conduit wherein the second elongated member is free to translate within the cavity of the first elongated member and wherein the anchor further comprises;

a manifold having a suction port, one or more blades, wherein each blade comprises a nozzle, and a flowpath between the suction port and each nozzle; and wherein the first elongated member has a cavity therein, a first end coupled to the manifold, and a first opening at a second end and the second elongated member has a first end inserted through the first opening into the cavity of the first elongated member and a second end coupled to the return conduit wherein the second elongated member is free to translate within the cavity of the first elongated member.

10. The system of claim 9, wherein the first elongated member further comprises a plurality of perforations.

11. The system of claim 9, wherein the first elongated member further comprises a plurality of perforations.

12. The system of claim 9, wherein the first elongated member comprises:

a cavity and an opening to the cavity, and wherein the anchor further comprises;

a retainer coupled to the second elongated member and disposed within the cavity, wherein a cross-section of the retainer is larger than the opening to the cavity, wherein the retainer is free to translate within the cavity of the elongated housing.

13. The system of claim 9, wherein said return conduit further comprises:

an upper portion that provides fluid communication between said pump module and said offshore structure; and a lower portion that provides fluid communication between said suction module and said pump module.

* * * * *